US008861174B2

(12) United States Patent
Jeppsson et al.

(10) Patent No.: US 8,861,174 B2
(45) Date of Patent: Oct. 14, 2014

(54) DEVICE AND METHOD FOR QUICK CLOSING OF AN ELECTRIC CIRCUIT AND A USE OF THE DEVICE

(71) Applicants: Ola Jeppsson, Vasteras (SE); Lars Paulsson, Vittsjo (SE)

(72) Inventors: Ola Jeppsson, Vasteras (SE); Lars Paulsson, Vittsjo (SE)

(73) Assignee: ABB Research Ltd. (CH)

( * ) Notice: Subject to any disclaimer, the term of this patent is extended or adjusted under 35 U.S.C. 154(b) by 0 days.

(21) Appl. No.: 14/071,002

(22) Filed: Nov. 4, 2013

(65) Prior Publication Data

US 2014/0055035 A1 Feb. 27, 2014

Related U.S. Application Data

(63) Continuation of application No. PCT/EP2012/058179, filed on May 4, 2012.

(30) Foreign Application Priority Data

May 5, 2011 (EP) ..... 11164925

(51) Int. Cl.

| | |
|---|---|
| ***F23Q 3/00*** | (2006.01) |
| ***F23Q 5/00*** | (2006.01) |
| ***H01T 2/02*** | (2006.01) |
| ***H05H 1/48*** | (2006.01) |
| ***H05H 1/50*** | (2006.01) |

(52) U.S. Cl.

CPC .. *H05H 1/48* (2013.01); *H01T 2/02* (2013.01); *H05H 1/50* (2013.01)

USPC ..... 361/253; 361/255

(58) Field of Classification Search

USPC ..... 361/40, 253, 255, 256, 257; 219/121.52, 121.56, 121.57, 69.1, 219/69.11, 69.15–69.17, 76.13–76.14

See application file for complete search history.

(56) References Cited

U.S. PATENT DOCUMENTS 3,725,729 A 4/1973 McDermott et al.
4,625,254 A 11/1986 Fahlen (Continued)

FOREIGN PATENT DOCUMENTS

WO 03096502 A1 11/2003

OTHER PUBLICATIONS

European Search Report Application No. EP 11 16 4925 Completed: Sep. 12, 2011; Mailing Date: Sep. 21, 2011 4 pages.

(Continued)

*Primary Examiner* — Minh D A

(74) *Attorney, Agent, or Firm* — St. Onge Steward Johnston & Reens LLC

(57) ABSTRACT

A device for quick closing of an electric circuit having a main spark gap with main electrodes and a triggering device. The triggering device has an auxiliary spark gap with auxiliary electrodes for igniting an arc in the main spark gap. The auxiliary electrodes are shielded from the main spark gap by a shielding unit having channel means extending therethrough from an auxiliary spark gap facing side to a main spark gap facing side of the shielding unit. The device further includes a nozzle with a first end being most close to the auxiliary spark gap and a second end most close to the main spark gap. The first end has an inlet opening that is in connection with the channel means and the second end has an outlet opening. The invention also relates to a corresponding method and to a use of the device.

17 Claims, 3 Drawing Sheets

(56) References Cited

U.S. PATENT DOCUMENTS

| | | | | |
|---|---|---|---|---|
| 4,652,963 | A | 3/1987 | Fahlen | |
| 4,703,385 | A | 10/1987 | Stenstrom | |
| 4,860,156 | A | 8/1989 | Stenstrom et al. | |
| 5,325,259 | A | 6/1994 | Paulsson | |
| 5,893,985 | A | 4/1999 | Luo et al. | |
| 6,700,091 | B2 | 3/2004 | Jones et al. | |
| 7,295,416 | B2 * | 11/2007 | Halvarsson et al. | 361/120 |
| 8,102,635 | B2 * | 1/2012 | Hallstrom et al. | 361/130 |
| 2008/0253040 | A1 | 10/2008 | Asokan et al. | |
| 2009/0134129 | A1 | 5/2009 | Robarge et al. | |

OTHER PUBLICATIONS

International Search Report & Written Opinion of the International Searching Authority Application No. PCT/EP2012/058179 Completed: May 23, 2013; Mailing Date: May 31, 2012 8 pages.

* cited by examiner

DEVICE AND METHOD FOR QUICK CLOSING OF AN ELECTRIC CIRCUIT AND A USE OF THE DEVICE

FIELD OF THE INVENTION

The present invention in a first aspect relates to a device for quick closing an electric circuit, said device comprising a main spark gap provided with a first and a second main electrode and a triggering device, said triggering device comprising an auxiliary spark gap provided with a first and a second auxiliary electrodes for igniting an arc in the main spark gap, said auxiliary electrodes being shielded from said main spark gap by a shielding unit having channel means extending therethrough from an auxiliary spark gap facing side to a main spark gap facing side.

In a second aspect the invention relates to a method for quickly closing an electric circuit by generating an arc between a first and a second main electrode of a main spark gap with the aid of a triggering device, wherein, when necessary, an arc is generated between a first and a second auxiliary electrode in an auxiliary spark gap associated with the triggering device, whereby an arc in the main spark gap is ignited with the aid of the arc in the auxiliary spark gap and the auxiliary spark gap is shielded from the main spark gap by a shielding unit having channel means extending therethrough from an auxiliary spark gap facing side to a main spark gap facing side.

In a third aspect the invention relates to a use of the invented device.

BACKGROUND OF THE INVENTION

Spark gaps adapted to generate an arc between the electrodes, and with a careful time determination, are utilized, inter alia, in high-voltage laboratories for triggering laser beams and as protection for series capacitors in electric power lines. The present invention is primarily intended for applications within the latter field but is not in any way limited thereto. Series capacitors are used in electric power lines, primarily for increasing the transmission capability of a power line. Such series capacitor equipment comprises a capacitor bank that is connected to the power line and is traversed by the current of the power line. The voltage across such a series capacitor becomes proportional to the current in the power line, and in case of an over current in the power line, for example caused by a short circuit in the power network, an overvoltage arises across the series capacitor. It is previously known, for the purpose of protecting the capacitor from such overvoltage, to connect the capacitor in parallel with a spark gap that is triggered in a suitable manner in case of an overvoltage across the capacitor. In this way, the line current is shunted past the capacitor, which in this way is protected. Known protection devices of this kind are described, for example, in U.S. Pat. No. 3,725,729, U.S. Pat. No. 4,625,254, U.S. Pat. No. 4,652,963, U.S. Pat. No. 4,703,385, U.S. Pat. No. 4,860,156, U.S. Pat. No. 5,325,259, U.S. Pat. No. 5,893,985, U.S. Pat. No. 6,700,091, U.S. 2008/253,040, U.S. 2009/134,129 and USH756.

One disadvantage of conventional ignition of the arc in the main spark gap based on an auxiliary spark gap, that is where the main spark gap is triggered to ignite via a spark generated by a triggering circuit, is that it requires a very high voltage across the main spark gap. The reason for this is that the mode of operation is based on the auxiliary spark gap substantially serving to ionize the air between the main electrodes. The ionization facilitates the formation of an arc between these; however, it assumes that the voltage is sufficient for a flashover to arise. The voltage across the main spark gap must amount to at least some 10 kV. This limits the possibilities of application. Further, it requires reconditioning of the spark gap even after a few discharges because the corrosion caused by the arc on the electrodes results in the electrode distance being influenced, which, in the case of such a conventional kind of spark-gap triggering, influences the tripping level, that is, at which voltage across the main spark gap that an arc is formed.

The above described disadvantages have to a large extent been overcome by the device disclosed in WO 03/096502. In the device of that disclosure each auxiliary electrode is provided with guide rails designed such that the arc, via the guide rails and under the influence of the generated inherent magnetic field, moves into the main electrode gap, each of the two guide rails having a length that is larger than the width of the auxiliary spark gap, and which auxiliary electrodes are arranged such that they are protected from the effect of plasma formed in the main spark gap and whereby a hermetic enclosure encloses the main spark gap and the auxiliary spark gap.

The generation of the arc in the main spark gap is achieved with that device in a way that is fundamentally physically different from what is achieved with conventional technique. With conventional technique, the arc in the main spark gap is achieved by an igniting spark from the auxiliary spark gap ionizing the air between the main electrodes so that a flashover arises therebetween, which presupposes a very high voltage therebetween. With the special design of the auxiliary spark gap according to the mentioned disclosure, the generation of the arc in the main spark gap is not correspondingly dependent on such ionization. The guide rails result in the arc in the auxiliary spark gap, by the inherent magnetic forces that arose around the arc, being brought to successfully move inwards towards the main spark gap so that gradually the arc is established between the electrodes of the main spark gap.

An important consequence of this difference is that no bias voltage is needed across the main spark gap in addition to the arc voltage drop and the electrode voltage drop. It may therefore be sufficient here with a voltage of the order of magnitude of 1 kV or even lower.

The fact that no high voltage is required across the main spark gap entails considerable advantages. The function of the spark gap will be relatively insensitive to the variation of its width. In this way, the spark gap need not be reconditioned after a discharge. The spark gap may thus be activated hundreds of times without any requirement for intermediate service. Further, the spark gap may be used for new functions where no high voltage arises when the spark gap is to be activated. Further, the spark gap is insensitive to the external environment, such as moisture, ice, snow, dirt and insects. Since the auxiliary electrodes are protected from the effect of plasma formed in the main spark gap, the risk that the arc in the main spark gap may damage the auxiliary electrodes is avoided.

SUMMARY OF THE INVENTION

An object of the present invention is to further improve a device of the kind in question.

This object is according to the first aspect of the invention achieved in that a device of the kind initially specified includes the specific features that the device further includes a nozzle with a first end being most close to the auxiliary spark gap and a second end most close to the main spark gap, which first end has an inlet opening that is in connection with said channel means.

The nozzle creates a collected arc plasma that will be more directed towards the main spark gap than what can be achieved with known technique, e.g. such as in the above mentioned WO 03/096502. The strong concentration of the plasma jet increases the effectiveness of the triggering device and leads to a very precise operation and shorter trigging time. A trigging time less than 0.5 ms can easily be achieved with the nozzle. The voltage required across the main spark gap for forming an arc can be further reduced by the presence of the nozzle.

According to an embodiment of the invention, the nozzle at least partly is arranged in said channel means.

The travelling of the arc from the auxiliary spark gap to the main spark gap thereby will be more secure since the risk for leakage between the shielding unit and the nozzle is prevented. Arranging the nozzle partly within the channel means also reduces the length of the triggering device. The integration of the nozzle with the shielding unit leads to a compact design.

According to an embodiment of the invention, at least a part of the nozzle is formed by channel walls of the channel means.

The integration of the nozzle and the shielding unit also in this respect provides a simple way of attaining the nozzle effect, where the channel means provides a part thereof.

According to an embodiment of the invention, a nozzle head portion is provided on the main spark facing side of the shielding unit, and the nozzle extends at least partly through the nozzle head portion.

A part of the nozzle thereby can be located in a part with smaller dimensions than what is required for the shielding unit. The space thus saved is advantageous with regards to the location of the outlet opening of the nozzle in relation to the main spark gap.

According to an embodiment of the invention, the shielding unit, the nozzle head portion and the nozzle are made in the same material in one single piece.

The integration of these parts leads to a compact construction that is easy to manufacture.

According to an embodiment of the invention, the interior of the nozzle is converging from the inlet opening to the outlet opening.

A converging nozzle results in that the travelling arc or plasma jet will be more focused such that it enhances the effect of igniting the arc in the main gap. Preferably the nozzle converges continuously. If the interior cross section of the nozzle is square or rectangular it can converge either in that only two of the opposite sides converge or all four. Should the cross section be circular or oval, the shape may be conical or conical-like respectively.

According to an embodiment of the invention, the outlet opening has an elongated shape.

It has been found that such a shape optimally corresponds to the geometrical context for the ignition of the main spark gap. The outlet opening thus has a basically rectangular shape, but it is preferred that the corners are rounded. Thereby the complete short sides may be shaped as circular arcs. Preferably also the inlet opening has a corresponding shape.

According to an embodiment of the invention the interior shape of the nozzle is elongated in any section thereof perpendicular to the longitudinal extension of the nozzle.

The travelling of the arc within the nozzle thereby will not be exposed to disturbing effects of shape changes and thus results in a harmonious operation.

According to an embodiment of the invention, the material of the nozzle is a polymer.

Thereby an appropriate material can be found that corresponds to the operation demands such as terminal and isolation properties and manufacturing demands. Suitable polymers are polyoxybenzylmethylenglycolanhydride (Bakelite), polyester, polyimide and polytetrafluorethylene (Teflon).

According to an embodiment of the invention, the material of the nozzle is polytetrafluorethylene.

It has been found out that polytetrafluorethylene is optimal for meeting the above demands. In particular with regards to the wear on the nozzle that occurs due to gasification of the material when affected by the arc, polytetrafluorethylene has shown to have a high ability to withstand this wear. A high number of operations thus can be performed without too much widening of the outlet opening.

According to an embodiment of the invention, at least one of the main electrodes is ring-shaped and the nozzle is arranged centrally with respect to the ring-shaped electrode.

Through this arrangement the distance between the electrodes can be reduced such that this location will be optimal with regards to create an arc in the main spark gap. The ring-shape of the electrodes thereby contributes to further reduce the trigging time.

According to an embodiment of the invention, each auxiliary electrode is provided with a guide rail designed such that the arc, via the guide rails and under the influence of the generated inherent magnetic field, moves towards the shielding wall unit.

This means that the nozzle is applied to the specific kind of device disclosed in the above mentioned WO 03/096502 and thus will have similar advantages as that device and which are described above. These advantages together with advantages of the nozzle according to present invention will have a synergetic effect.

The invention also relates to a series capacitor that includes an overvoltage protection apparatus provided with a device according to the present invention, in particular to any of the above described embodiments thereof.

Since the invented device is of special interest as a component in such an apparatus, the invented overvoltage apparatus implies that the advantages of the invented device are used in a field where these advantages are made use of to a large extent.

According to a second aspect of the invention, the object is achieved in that a method of the kind introductionally specified further includes the specific steps of arranging a nozzle with a first end being most close to the auxiliary spark gap and a second end most close to the main spark gap, arranging an inlet opening at the first end, connecting the inlet opening to said channel means and arranging an outlet opening at the second end, and thereby directing an arc from the auxiliary spark gap to move to the main spark gap via the nozzle.

According to an embodiment of the invented method, it is carried out while utilizing a device according to the present invention, in particular to any of the embodiments thereof.

According to a third aspect of the invention, the object is achieved in that the invented device is used for quickly closing an electric high voltage circuit.

According to an embodiment of the invented use, the device is used to protect a series capacitor from overvoltage.

The invented method and the invented use and the above described embodiments of these have similar advantages as those of the invented device and the above described embodiments thereof.

While the above described embodiments of the invention are specified, it is to be understood that further embodiments of course can be constituted by any possible combination of the embodiments above and by any possible combination of these and features mentioned in the description of an example below.

The invention will be further explained through the following detailed description of an example thereof and with reference to the accompanying drawings.

DETAILED DESCRIPTION OF THE INVENTION

Figure 1:
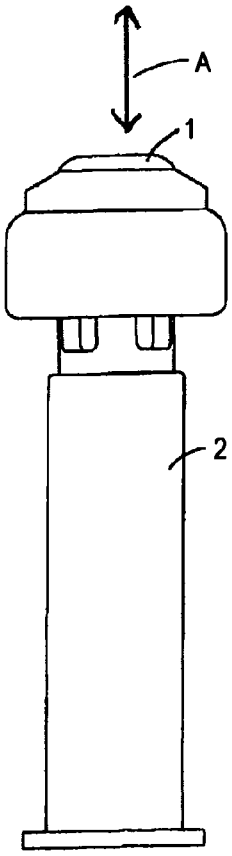
FIG. 1 is a side view of an electrode and its supporting structure according to the present invention.

FIG. 1 in a side view illustrates one of the main electrodes 1 in a device according to the invention. The electrode 1, is mounted on a support structure 2 and cooperates with a second electrode (not shown) forming a main spark gap A between each other. The electrode 1 has the shape of a circular ring and may be of cupper. The device is located within a hermetic enclosure (not shown).

The general function of such a device is described in detail in the above mentioned WO 03/096502, which hereby is incorporated by reference. Specific reference is made to FIGS. 1 and 2 of that disclosure and the corresponding parts of the description regarding an example how the triggering device may be constructed, how the auxiliary spark gap can be constructed and how the arc in the auxiliary spark gap functions to create an arc in the main spark gap. The focus of the present invention is related to the construction of the triggering device in the region between the shielding device and the main spark gap.

Figure 2:
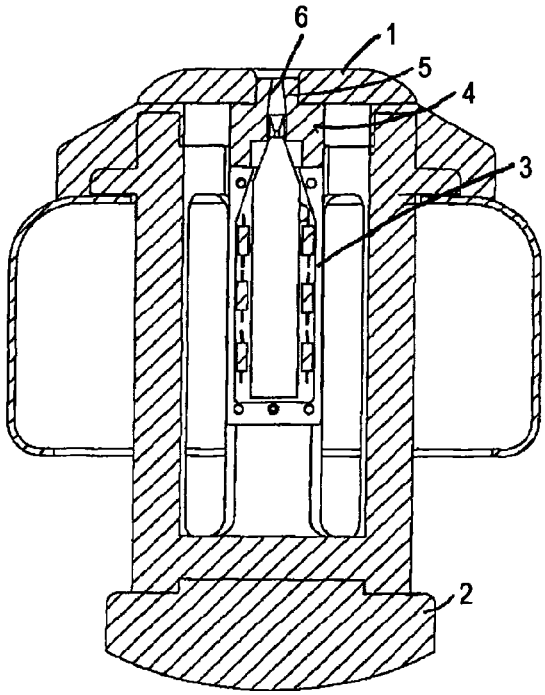
FIG. 2 is a first diametrical section through the upper part of FIG. 1.
Figure 3:
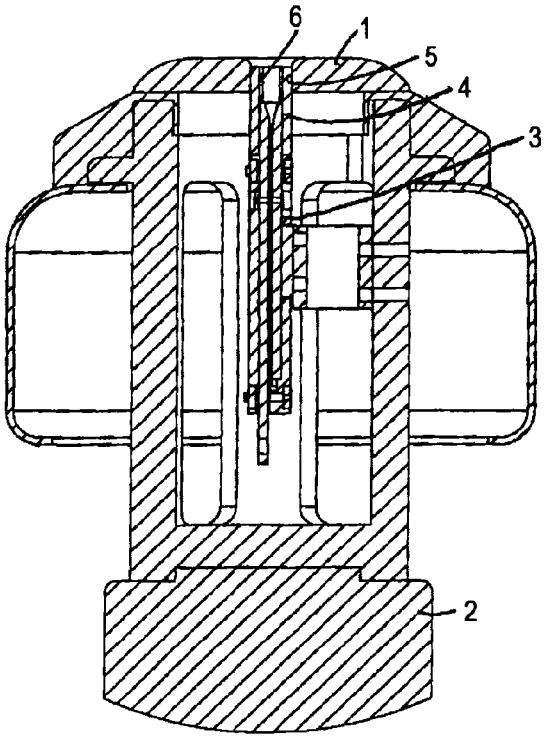
FIG. 3 is a second diametrical section through the upper part of FIG. 1, orthogonal to the section of FIG. 2.

The upper part of FIG. 1 is illustrated in FIGS. 2 and 3 in two diametrical sections which are orthogonal to each other. The triggering device 3 has a shell enclosing a triggering circuit and a pair of auxiliary electrodes forming an auxiliary spark gap. This device will be explained further below in connection with FIG. 9.

At the upper end the triggering device 3 is covered by a shielding unit 4, through which a central channel means extends. On top of the shielding unit 4 there is a nozzle head portion 5. The inside of the nozzle head portion 5 and the upper part of the channel means within the shielding unit 4 form a nozzle 6, through which the arc from the auxiliary spark gap in the triggering device moves towards the main spark gap A.

Figure 4:
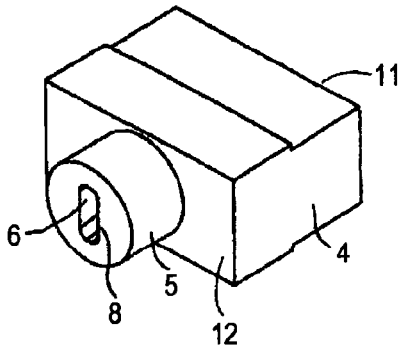
FIG. 4 is a perspective view of a detail in FIGS. 2 and 3.

The arrangement of the nozzle 6 in relation to the shielding unit 4 and the nozzle head portion 5 is explained more in detail with reference to FIG. 4-8. In FIG. 4 the component formed by the shielding unit 4 and the nozzle head portion 5 can be seen in perspective. The shielding unit 4 is substantially box shaped with a rectangular cross section perpendicular to the longitudinal extension of the nozzle 6. The shielding unit 4 has an auxiliary spark gap facing side 11 directed towards the triggering device and a main spark facing side 12 directed towards the main spark gap A. The nozzle head portion 5 is mounted on the main spark facing side 11 of the shielding unit 4 and has circular cylindrical shape. The shielding unit 4 and the nozzle head portion 5 are in this example made as one piece and the material is polytetrafluorethylene. At the end of the nozzle head portion 5 the outlet opening 8 of the nozzle 6 can be seen. The outlet opening 8 has an elongated shape.

Figure 5:
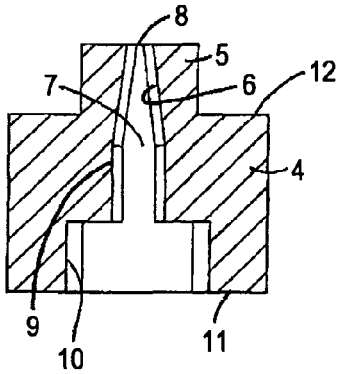
FIG. 5 is a first section through the detail of FIG. 4.

FIG. 5 is a section through FIG. 4 taken along a central plane in parallel with the large sides of the shielding unit 4. The channel means through the shielding unit 4 has a lower wide part 10 close to the auxiliary spark gap and an upper more narrow part 9 close to the nozzle 6. Each of these parts have parallel straight walls. The nozzle 6 connects to the upper end of the narrow part 9 of the channel means. The nozzle 6 is in this section converging from its inlet opening 7 connected to part 9 to its outlet opening 8. As can be seen the nozzle in this example extends partly through the nozzle head portion 5 and partly through the upper part of the shielding unit 4.

Figure 6:
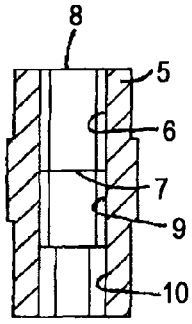
FIG. 6 is a second section through the detail of FIG. 4.
Figure 7:
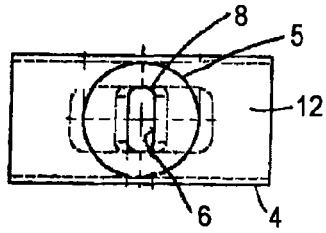
FIG. 7 is a top end view of the detail in FIG. 4.
Figure 8:
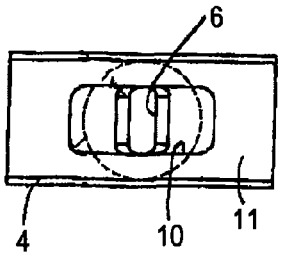
FIG. 8 is a bottom end view of the detail in FIG. 4.

FIG. 6 is a section orthogonal to that of FIG. 5. In this section the channel means 9, 10 and the nozzle 6 have the same width and straight parallel walls. The top end and the bottom end of the component in FIG. 4 is shown in a respective end view in FIGS. 7 and 8, respectively.

In the above example the shielding unit 4 has the dimensions 40×28×20 mm. The nozzle head portion has a height of 11 mm and a diameter of 18 mm. The lower part 10 of the channel means has a depth of 11 mm and a cross section of 22×10 mm, the upper part a depth of 12 mm and a cross section of 8×10 mm. The converging nozzle 6 has a length of 16 mm. The inlet opening 7 of the nozzle has a length of 10 mm and a width of 8 mm and the outlet opening 8 a length of 10 mm and a width of 4 mm.

Figure 9:
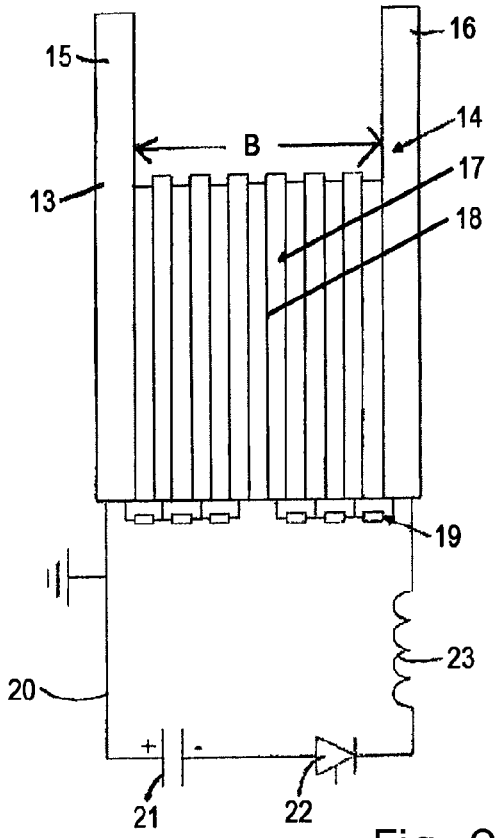
FIG. 9 is a schematic illustration of the auxiliary spark gap according to the invention.

The auxiliary spark gap B is illustrated schematically in FIG. 9. It has a first auxiliary electrode 13 and a second auxiliary electrode 14. Each of these electrodes has an elongation forming a respective guiding rail 15, 16. The guiding rails 15, 16 have the function to lead the arc generated in the auxiliary spark gap B towards the shielding unit 4, through the same and through the nozzle 6 to reach the main spark gap for generating an arc therein.

The triggering circuit 20 for the auxiliary electrodes 13, 14 has a capacitor bank 21 with one side connected to the first auxiliary electrode 13 and to ground. The other side is via a coil 23 and a normally open closer 22, in this example in the form of a thyristor, connected to the second auxiliary electrode 14.

Upon a command the closer 22 closes in order to trigger an arc in the auxiliary spark gap B. Between the auxiliary electrodes 13, 14 a number of subelectrodes 17 are arranged, which may be of cupper. A layer of an insulating material 18 is provided between each pair of subelectrodes 17 and between each auxiliary electrode 13, 14 and the respective closest subelectrode. A resistor 19 connects each pair of subelectrodes to each other and each auxiliary electrode 13, 14 to the nearest subelectrode.

Figure 10:
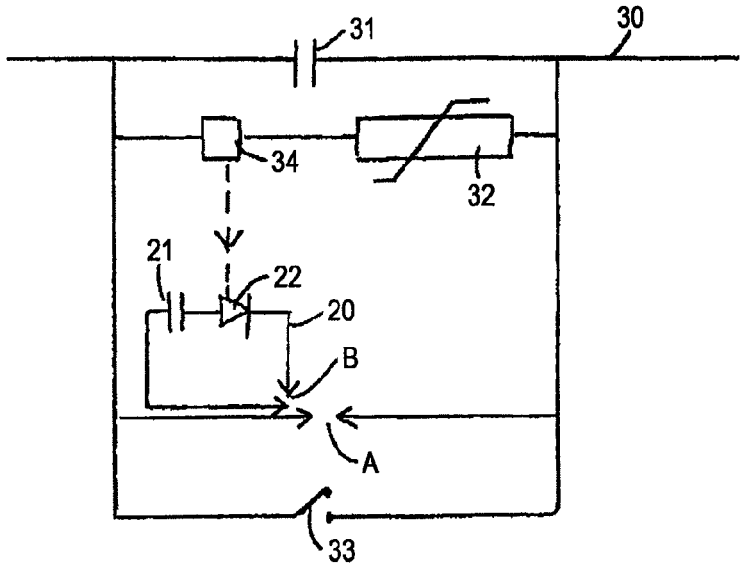
FIG. 10 illustrates a series capacitor provided with an over voltage protection device according to the present invention.

FIG. 10 shows a diagram where the device is applied as overvoltage protection device for a series capacitor. In a power line 30 with a series capacitor 31, there is arranged an overvoltage protection device comprising a varistor 32, a main spark gap A and a mechanical contact device 33, these three components being connected in parallel. A current-measuring device 34 is arranged in series with the varistor.

At an over current in the power line 30, for example as a result of a short-circuit in the network, an overvoltage arises across the capacitor 31. The current through the varistor 32 is measured with the current-measuring device 34. The measurement is integrated for a period of a few ms to some 20 or 30 ms, and the volume of energy measured constitutes a criterion as to whether the overvoltage protection device is to be activated or not. The threshold value, at which activation occurs, may be of the order of magnitude of some 20 or 30 MJ. The current-measuring device 34 thus defines when there is a need to generate an arc.

When this is the case, the current-measuring device sends a signal to the closer 22. This leads to the generation of an arc in the auxiliary spark gap B, and this arc ignites an arc in the main spark gap A. At the same time, the contact device 33 is activated to close.

What is claimed is:

1. A device for quick closing of an electric circuit, said device comprising a main spark gap provided with a first and a second main electrode and a triggering device, said triggering device comprising an auxiliary spark gap provided with a first and a second auxiliary electrodes for igniting an arc in the main spark gap, said auxiliary electrodes being shielded from said main spark gap by a shielding unit having channel means extending therethrough from an auxiliary spark gap facing side to a main spark gap facing side of the shielding unit, characterized in that the device further includes a nozzle with a first end being most close to the auxiliary spark gap and a second end most close to the main spark gap, which first end has an inlet opening that is in connection with said channel means and which second end has an outlet opening.

2. The device according to claim 1, characterized in that the nozzle at least partly is arranged in said channel means.

3. The device according to claim 2, characterized in that at least a part of the nozzle is formed by channel walls of the channel means.

4. The device according to claim 1, characterized in that a nozzle head portion is provided on the main spark facing side of the shielding unit and in that the nozzle at least partly extends through said nozzle head portion.

5. The device according to claim 4, characterized in that the shielding unit, the nozzle head portion and the nozzle are made of the same material in one single piece.

6. The device according to claim 1, characterized in that the interior of the nozzle is converging from the inlet opening to the outlet opening.

7. The device according to claim 1, characterized in that the outlet opening has an elongated shape.

8. The device according to claim 7, characterized in that the interior shape of the nozzle is elongated in any section thereof perpendicular to the longitudinal extension of the nozzle.

9. The device according to claim 1, characterized in that the material of the nozzle is a polymer.

10. The device according to claim 9, characterized in that the material of the nozzle is polytetrafluorethylene.

11. The device according to claim 1, characterized in that at least one of said main electrodes is ring-shaped and in that the nozzle is arranged centrally with respect to said ring-shaped electrode.

12. The device according to claim 1, characterized in that each auxiliary electrode is provided with a guide rail designed such that the arc, via the guide rails and under the influence of the generated inherent magnetic field, moves towards the shielding unit.

13. A series capacitor, characterized in that the series capacitor includes an overvoltage protection apparatus provided with a device according to claim 1.

14. A method for quickly closing an electric circuit by generating an arc between a first and a second main electrode of a main spark gap with the aid of a triggering device, wherein, when necessary, an arc is generated between a first and a second auxiliary electrode in an auxiliary spark gap associated with the triggering device, whereby an arc in the main spark gap is ignited with the aid of the arc in the auxiliary spark gap and the auxiliary spark gap is shielded from the main spark gap by a shielding unit having channel means extending therethrough from an auxiliary spark gap facing side to a main spark gap facing side, characterized by arranging a nozzle with a first end being most close to the auxiliary spark gap and a second end most close to the main spark gap, arranging an inlet opening at the first end, connecting the inlet opening to said channel means and arranging an outlet opening at the second end, and thereby directing an arc from the auxiliary spark gap to move to the main spark gap via the nozzle.

15. The method according to claim 14, characterized in that the method is carried out while utilizing a device comprising a main spark gap provided with a first and a second main electrode and a triggering device, said triggering device comprising an auxiliary spark gap provided with a first and a second auxiliary electrodes for igniting an arc in the main spark gap, said auxiliary electrodes being shielded from said main spark gap by a shielding unit having channel means extending therethrough from an auxiliary spark gap facing side to a main spark gap facing side of the shielding unit, characterized in that the device further includes a nozzle with a first end being most close to the auxiliary spark gap and a second end most close to the main spark gap, which first end has an inlet opening that is in connection with said channel means and which second end has an outlet opening.

16. A use of a device for quickly closing an electric high voltage circuit, said device comprising a main spark gap provided with a first and a second main electrode and a triggering device, said triggering device comprising an auxiliary spark gap provided with a first and a second auxiliary electrodes for igniting an arc in the main spark gap, said auxiliary electrodes being shielded from said main spark gap by a shielding unit having channel means extending therethrough from an auxiliary spark gap facing side to a main spark gap facing side of the shielding unit, characterized in that the device further includes a nozzle with a first end being most close to the auxiliary spark gap and a second end most close to the main spark gap, which first end has an inlet opening that is in connection with said channel means and which second end has an outlet opening.

17. The according to claim 16, characterized in that the device is used to protect a series capacitor from overvoltage.

* * * * *